US012516589B2

(12) United States Patent
Arabnejad Khanouki et al.

(10) Patent No.: US 12,516,589 B2
(45) Date of Patent: Jan. 6, 2026

(54) DOWNHOLE FLOW CONTROL VALVE FOR WELL SYSTEMS

(71) Applicant: Halliburton Energy Services, Inc., Houston, TX (US)

(72) Inventors: Hadi Arabnejad Khanouki, Carrollton, TX (US); Ahmed Hafiz Abdalla, Spring, TX (US); Paul James, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 130 days.

(21) Appl. No.: 18/471,883

(22) Filed: Sep. 21, 2023

(65) Prior Publication Data

US 2025/0101832 A1 Mar. 27, 2025

(51) Int. Cl.
*E21B 34/14* (2006.01)
*E21B 43/14* (2006.01)

(52) U.S. Cl.
CPC ..... *E21B 34/14* (2013.01); *E21B 43/14* (2013.01); *E21B 2200/02* (2020.05); *E21B 2200/06* (2020.05)

(58) Field of Classification Search
CPC ... E21B 34/14; E21B 2200/06; E21B 2200/02
See application file for complete search history.

(56) References Cited

U.S. PATENT DOCUMENTS 6,260,616 B1 * 7/2001 Carmody ..... E21B 34/066 137/625.33
9,677,378 B2 6/2017 Asthana et al.
9,816,348 B2 11/2017 Asthana et al.
2004/0112608 A1 * 6/2004 Jackson ..... E21B 34/14 166/334.4
2006/0284134 A1 * 12/2006 Dwivedi ..... F16K 5/0428 251/208

(Continued)

FOREIGN PATENT DOCUMENTS

EP 2385212 11/2011
WO 2018009884 1/2018

OTHER PUBLICATIONS

"PCT Application No. PCT/US2023/074939, International Search Report and Written Opinion", Jun. 10, 2024, 10 pages.

*Primary Examiner* — Cathleen R Hutchins
(74) *Attorney, Agent, or Firm* — DeLizio, Peacock, Lewin & Guerra LLP

(57) ABSTRACT

Systems, methods, and apparatus including a downhole flow control valve that may be used in well systems. The downhole flow control valve may include a flow trim component and a ported housing. The flow trim component may include a plurality of ports that are arranged in a staggered configuration and allow a fluid flow into and out of a well tubing of the well system. The ported housing may include a ramp and a window providing access to the plurality of ports in the staggered configuration. The ramp may have a first angle of inclination and the plurality of ports of the flow trim component may have a second angle of inclination. The flow trim component may include flow trim sections positioned around a circumference of the flow trim component, and the ported housing may include ported housing sections positioned around a circumference of the ported housing.

17 Claims, 6 Drawing Sheets

(56) References Cited

U.S. PATENT DOCUMENTS

| | | | | |
|---|---|---|---|---|
| 2012/0048562 | A1* | 3/2012 | Zimmerman | E21B 43/045 166/317 |
| 2012/0097386 | A1 | 4/2012 | Ward et al. | |
| 2017/0114609 | A1 | 4/2017 | Asthana et al. | |
| 2021/0140280 | A1 | 5/2021 | Malone et al. | |

* cited by examiner

DOWNHOLE FLOW CONTROL VALVE FOR WELL SYSTEMS

TECHNICAL FIELD

The present invention relates generally to oil and gas systems and services, and more specifically to a downhole flow control valve for well systems.

BACKGROUND

The oil and gas services industry uses various types of downhole well devices or tools in well systems. For example, well systems typically include one or more downhole flow control valves, such as one or more interval control valves (ICVs). A downhole flow control valve may include a flow trim and a ported housing. Typical designs of the flow trim and the ported housing cause the downhole flow control valve to have a relatively short lifespan due to progressive erosion. For example, typical designs of the flow trim and the ported housing concentrate the fluid flow to one area or a few areas of the downhole flow control valve, which result in significant erosion. Also, typical designs of the flow trim and the ported housing direct the fluid flow, and the erosion energy, toward one or more vulnerable parts of the downhole flow control valve, such as the tubing to annulus (and annulus to tubing) seal of the downhole flow control valve. Furthermore, the complex geometry of the downhole flow control valve and the way the fluid flow changes its direction from casing to tubing through the ported housing and the flow trim ports can make erosion prediction challenging, especially with the progression of erosion which results in geometrical changes to the ported housing and the flow trim ports.

DESCRIPTION

The description that follows includes example systems, methods, techniques, and program flows that describe aspects of the disclosure. However, it is understood that this disclosure may be practiced without these specific details. For instance, this disclosure refers to certain well devices or tools in illustrative examples. Aspects of this disclosure can be instead applied to other types of well devices and tools.

In other instances, well-known instruction instances, protocols, structures, and techniques have not been shown in detail to avoid confusion.

Figure 1:
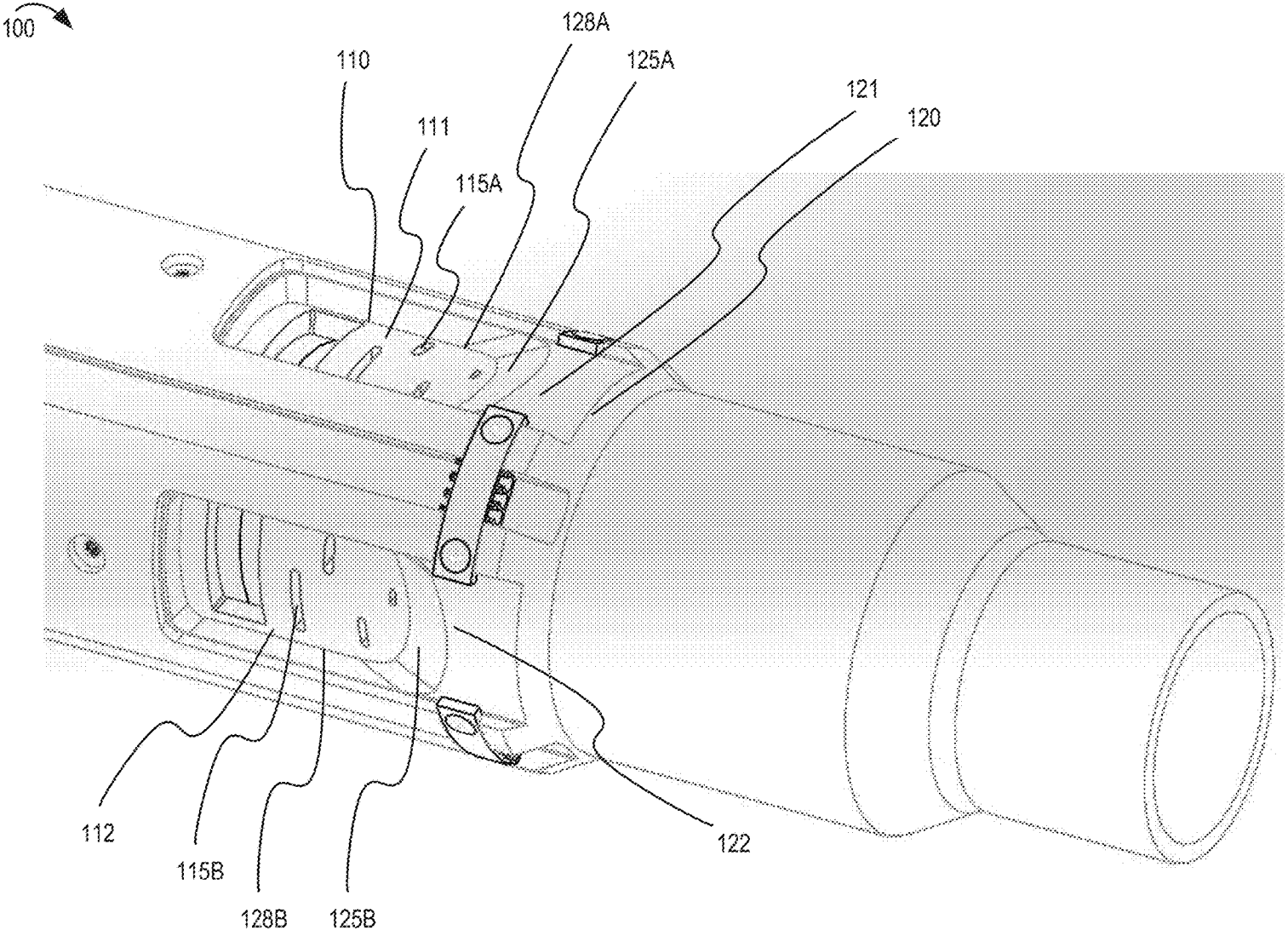
FIG. 1 depicts a conceptual diagrams of an example downhole flow control valve 100 for well systems, according to some implementations.

FIG. 1 depicts a conceptual diagrams of an example downhole flow control valve 100 for well systems, according to some implementations. In some implementations, the flow control valve 100 may be an interval control valve (ICV). It is noted, however, that the flow control valve 100 may be other types of valves and tools that are used in well systems for flow control. It is also noted that the flow control valve may also be referred to as an inflow or outflow control valve. In some implementations, the flow control valve 100 may allow a fluid flow between a well tubing or pipe of the well system and an annulus of the well system (e.g., such as the annulus between the tubing and casing of the well system). In some implementations, the downhole flow control valve 100 may include a flow trim 110 and a ported housing 120. The features of the flow trim 110 and the ported housing 120 (described further below) may allow the erosion energy during well operation to be diverted away from vulnerable parts of the downhole flow control valve 100, may smooth the change of the fluid flow direction to ensure the change takes place gradually, and may distribute the erosion energy over a large portion of the flow trim circumference (instead of the erosion energy being concentrated in one area or a few areas). Thus, the features of the flow trim 110 and the ported housing 120 may significantly reduce the erosion damage on the flow control valve 100 and increase the operating life span of the flow control valve 100.

In some implementations, the flow trim 110 (which also may be referred to as the flow trim component 110) may include multiple ports, such as ports 115A and ports 115B), that are arranged in a staggered configuration. The multiple ports, such as ports 115A, ports 115B, and other similar ports) that are positioned in a staggered configuration may generally and collectively be referred to as ports 115 or staggered ports 115. The flow trim 110 may include multiple sections positioned in the circumference of the flow trim 110, and each flow trim section may include multiple staggered ports 115. In some implementations, the flow trim 110 may include a first flow trim section 111 having a first plurality of staggered ports 115A and at least a second flow trim section 112 having a second plurality of staggered ports 115B. In some implementations, the flow trim 110 may include a third flow trim section (not shown) having a third plurality of staggered ports, and a fourth flow trim section (not shown) having a fourth plurality of staggered ports. The first, second, third, and fourth pluralities of staggered ports may collectively be referred to as the plurality of staggered ports 115. It is noted, however, that the flow trim 110 may include any number of flow trim sections and any number of corresponding staggered ports 115. In some implementations, the plurality of staggered ports 115 may be inclined or have an angle of inclination, as further described below. In some implementations, the ported housing 120 may include a plurality of sections positioned in the circumference of the ported housing 120, and each ported housing section may include a ramp 125 and a window 128 that allows access to the corresponding section of the flow trim 110. The ramp 125 may also be referred to as an incline. The window 128 may also be referred to as a big window or may be referred to as having a big window configuration or design. In some implementations, the ported housing 120 may include a first ported housing section 121 having a first ramp 125A and a first window 128A, and at least a second ported housing section 122 having a second ramp 125B and a second window 128B. In some implementations, the ported housing 120 may include a third ported housing section (not shown) having a third ramp and a third window, and a fourth ported housing section having a fourth ramp and a fourth window. The first, second, third, and fourth ramps may be collectively referred to as the ramps 125 or the plurality of ramps 125, and the first, second, third, and fourth windows may be collectively referred to as the windows 128 or the plurality of windows 128. As shown in FIG. 1, the ported housing sections may allow the fluid flow (such as a flow of a liquid or gas) access to the corresponding flow trim sections. For example, the first ported housing section 121 having a first ramp 125A and a first window 128A may allow the fluid flow access to the first flow trim section 111 having the first plurality of staggered ports 115A, and the second ported housing section 122 having a first ramp 125B and a first window 128B may allow the fluid flow access to the first flow trim section 112 having the second plurality of staggered ports 115B.

In some implementations, when the flow trim 110 has four flow trim sections (such as the flow trim 110 shown in FIG. 1), the first flow trim section 111 may be positioned approximately opposite the third flow trim section in the circumference of the flow trim 110, and the second flow trim section 112 may be positioned approximately opposite the fourth flow trim section in the circumference of the flow trim 110. It is noted, however, that the flow trim 110 may include any number of flow trim sections. In some implementations, when the ported housing 120 has four ported housing sections (such as the ported housing 120 shown in FIG. 1), the first ported housing section 121 may be positioned approximately opposite the third ported housing section in the circumference of the ported housing 120, and the second ported housing section 122 may be positioned approximately opposite the fourth ported housing section in the circumference of the ported housing 120. It is noted, however, that the ported housing 120 may include any number of ported housing sections.

In some implementations, the plurality of staggered ports 115 may allow and control the fluid flow (such as control the flow of a liquid or gas or particulate) into the flow control valve 110 and into the well tubing of the well system, and/or allow and control the fluid flow out of the well tubing and out of the flow control valve 110 and into the annulus. For example, in an uphole flow direction, the fluid flow may enter the flow control valve 110 from the annulus (such as the annulus between the casing and the well tubing) and enter the well tubing, and in a downhole direction, the fluid may leave the well tubing and the flow control valve 110 and enter the annulus. In some implementations, the ported housing 120 having a big window design with an inclined ramp may provide a smooth flow direction transition, protect against back flow erosion, and significantly reduced the flow turbulence and the erosion impact on part of the ported housing 120. In typical ported housing designs, the ported housing typically has separate ports that line up with the flow trim ports. The ports of typical ported housing designs are significantly affected by erosion and cause an erosion pattern that is challenging to predict. In some implementations, the ported housing 120 having a big window and ramp eliminates or removes the ports and the port walls that are found in typical designs and smooths the fluid flow, both of which reduce the erosion energy and flow turbulence. In some implementations, by having the flow trim ports arranged in a staggered configuration, the plurality of staggered ports 115 may distribute the fluid flow through the ports (which may be referred to as the fluid flow jets) to different spots on the tool bore, and to more robust parts of the tool, to distribute the erosion energy across a broad area and reduce erosion. In typical flow trim designs, the flow trim ports are not staggered and the fluid flow jets are aligned and concentrate the flow energy. Concentrating the flow energy from the flow jets on a narrower area or more focused areas of the tool results in significant erosion in one or more areas of the tool. In some implementations, the plurality of staggered ports 115 may also be inclined or have an angle of inclination, as further shown in FIGS. 2-3. The plurality of staggered ports 115 with the angle of inclination may direct the fluid flow (such as the fluid flow jets) and the erosion energy (including any turbulence) associated with the fluid flow in a direction that is away from the more vulnerable parts of the tool, such as the seal between the tubing and annulus.

Figure 3:
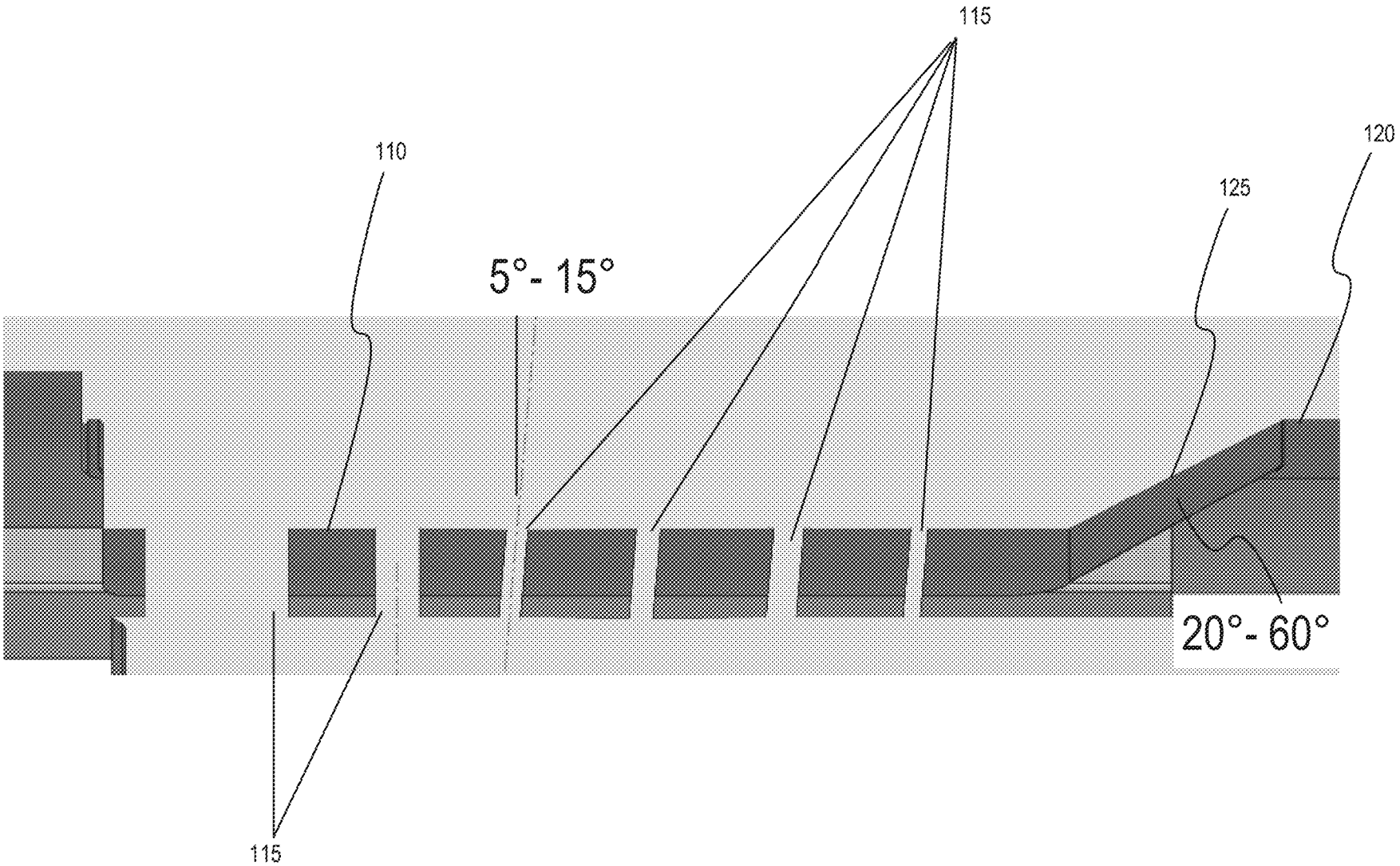
FIG. 3 depicts a conceptual cross-sectional diagram showing an example flow trim and ported housing of the downhole flow control valve, according to some implementations.

In some implementations, the angle of inclination of each ramp 125 positioned in each section of the ported housing 120 may be an angle of between 20 degrees and 60 degrees from a horizontal axis of the tool (as further shown in FIG. 3). In some implementations, the angle of inclination of each ramp 125 may be an angle between 20 degrees and 40 degrees. It is noted however, that in other implementations the angle of inclination of each ramp 125 may be an angle in other angle ranges, such as an angle between 10 degrees and 70 degrees. In some implementations, the angle of inclination is selected to reduce turbulence and keep the fluid flow attached to (or close to) the surface of the tool (such as the surface of the ported housing 120 and the flow trim 110). For example, the selected angle of inclination may be chosen based on the fluid and flow velocity that is expected to traverse the ramp 125. In some implementations, the angle of inclination of the ramp 125 may also be optimized differently when the fluid flow is progressing up the ramp 125 (such as when the flow is from the tubing to the annulus) compared to when the fluid flow is progressing down the ramp 125 (such as when the flow is from the annulus to the tubing). In some implementations, the angle of inclination of each of the ramps 125 across the different ported housing sections may be approximately the same angle. For example, the angle of inclination of the ramp in one of the ported housing sections (e.g., such as the ramp 125A of the ported housing section 121) may be the same angle as the angle of inclination of the ramp in another one of the ported housing sections (e.g., such as the ramp 125B of the ported housing section 122). It is also noted that in other implementations the angle of one or more of the ramps may be different compared to the other ramps across the different ported housing sections. For example, the angle of inclination of the ramp in one of the ported housing sections (e.g., such as the ramp 125A of the ported housing section 121) may be a different angle as the angle of the ramp in another one of the ported housing sections (e.g., such as the ramp 125B of the ported housing section 122).

In some implementations, the angle of inclination of each staggered port 115 positioned in each section of the flow trim 110 may be an angle of between 5 degrees and 15 degrees from a vertical axis of the tool (as further shown in FIG. 3). In some implementations, the angle of inclination of each staggered port 115 may be an angle between 5 degrees and 10 degrees. It is noted however, that in other implementations the angle of inclination of each staggered port 115 may be an angle in other angle ranges, such as an angle between 3 degrees and 20 degrees. In some implementations, the angle of inclination of each of the staggered ports 115 across the different ported housing sections may be approximately the same angle. For example, the angle of inclination of the staggered ports in one of the flow trim sections (e.g., such as the staggered ports 115A of the flow trim section 111) may be the same angle as the angle of inclination of the staggered ports in another one of the flow trim sections (e.g., such as the staggered ports 115B of the flow trim section 112). It is also noted that in other implementations the angle of one or more of the staggered ports may be different compared to the other staggered ports across the different flow trim sections. For example, the angle of inclination of the staggered ports in one of the flow trim sections (e.g., such as the staggered ports 115A of the flow trim section 111) may be a different angle as the angle of the staggered ports in another one of the flow trim sections (e.g., such as the staggered ports 115B of the flow trim section 112). In some implementations, the angle of inclination of one or more of the individual ports in one or more of the flow trim sections (such as the flow trim section 111 and/or the flow trim section 112) may be different than one or more other ports in the flow trim section, as further described in FIG. 2. For example, the angle of inclination for one or more of the individual ports in one or more of the flow trim sections may vary based on different fluid flow requirements within the corresponding flow trim section.

In some implementations, the downhole flow control valve 100 having the flow trim 110 including the staggered ports and the ported housing 120 including the big window and ramp may significantly increase the lifespan of the flow control valve 100 in a highly erosive environment. The downhole flow control valve 100 having the flow trim 110 and the ported housing 120 may reduce the ambiguity of the progressive erosion of the ported housing 120, since the erosion is difficult to predict in typical designs. The downhole flow control valve 100 having the flow trim 110 and the ported housing 120 may be simpler to manufacture (compared to typical designs) and may maintain or reduce the manufacturing cost.

Figure 2:
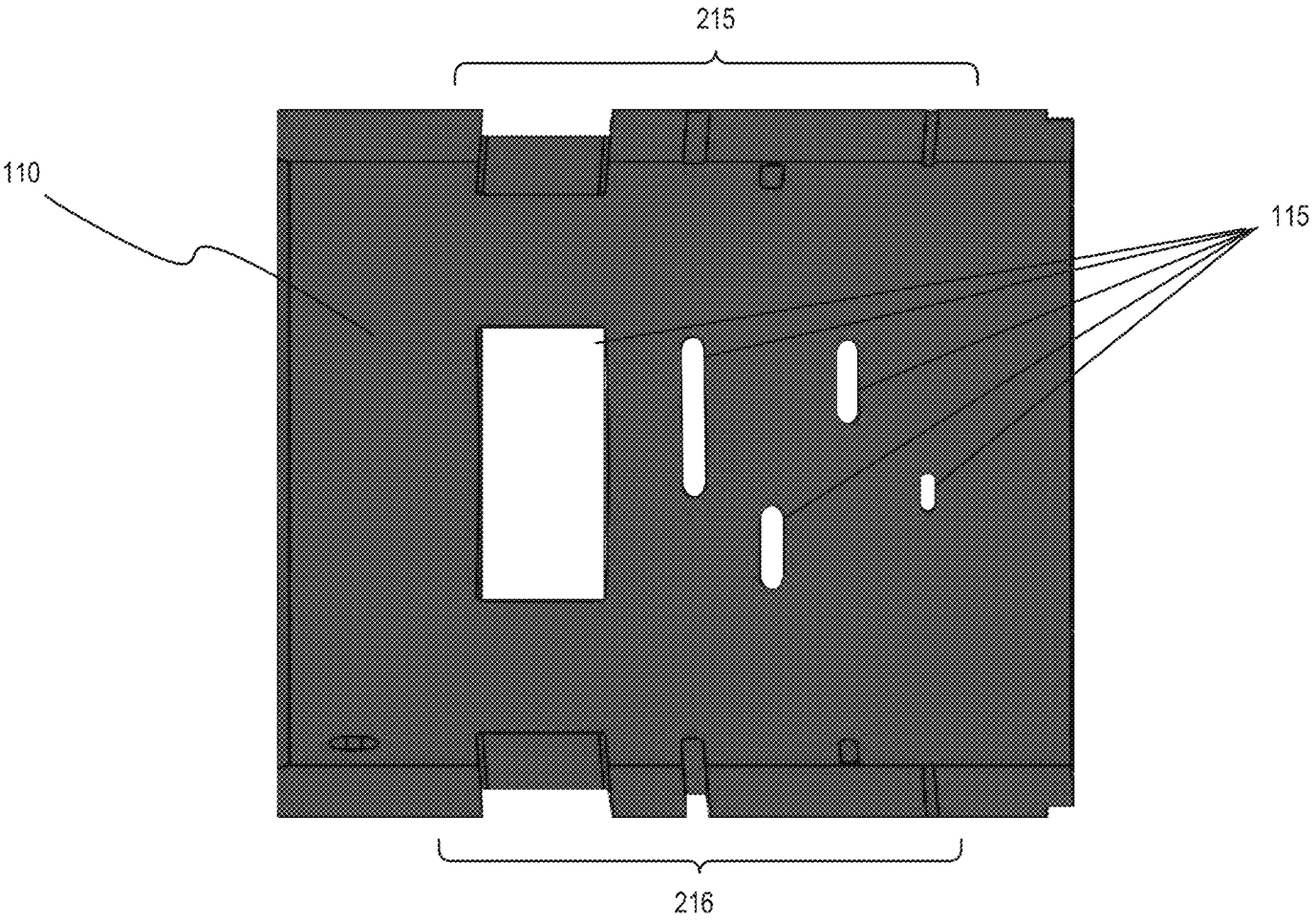
FIG. 2 depicts a conceptual diagram showing an example flow trim of the downhole flow control valve, according to some implementations.

FIG. 2 depicts a conceptual diagram showing an example flow trim 110 of the downhole flow control valve 100, according to some implementations. As noted above, the flow trim 110 may also be referred to as the flow trim component. The flow trim 110 may include a plurality of ports 115 arranged in a staggered configuration, which may be referred to as staggered ports 115. FIG. 2 may show one of the flow trim sections of the flow trim 110 that were shown in FIG. 1. For example, FIG. 2 may show a first flow trim section 111 having a first plurality of staggered ports 115A, a second flow trim section 112 having a second plurality of staggered ports 115B, a third flow trim section having a third plurality of staggered ports, or a fourth flow trim section having a fourth plurality of staggered ports. In the example shown in FIG. 2, the flow trim section includes five ports. It is noted, however, that in other implementations, the plurality of staggered ports 115 may include any number of ports, such as between four and eight ports.

As described in FIG. 1, the staggered ports 115 may be inclined or have an angle of inclination. The cross-section views 215 and 216 of the flow trim 110 show one example of the angle of inclination of the staggered ports 115. In some implementations, the angle of inclination of each staggered port 115 may be an angle of between 5 degrees and 15 degrees from a vertical axis of the tool (as further shown in FIG. 3). It is noted, however, that in other implementations the angle of inclination of each staggered port 115 may be an angle in other angle ranges, such as an angle between 3 degrees and 20 degrees. In some implementations, the angle of inclination of one or more of the individual ports in one or more of the flow trim sections (such as the flow trim section 111 and/or the flow trim section 112) may be different than one or more other ports in the flow trim section. For example, one or more of the staggered ports 115 shown in FIG. 2 may have a larger angle of inclination compared to the other (one or more) staggered ports 115. As another example, each of the staggered ports 115 may have a different angle of inclination.

FIG. 3 depicts a conceptual cross-sectional diagram showing an example flow trim 110 and ported housing 120 of the downhole flow control valve 100, according to some implementations. As described in FIG. 1, the flow trim 110 may include a plurality of ports 115 arranged in a staggered configuration, which may be referred to as staggered ports 115. The staggered ports may be inclined or include an angle of inclination. Since FIG. 3 is a cross-section view, FIG. 3 does not show the staggered configuration that was shown in FIGS. 1-2. However, FIG. 3 shows the angle of inclination of the ports 115. In some implementations, as shown in FIG. 3, the angle of inclination of each staggered port 115 may be an angle of between 5 degrees and 15 degrees from a vertical axis of the tool. It is noted, however, that in other implementations the angle of inclination of each staggered port 115 may be an angle in other angle ranges, such as an angle between 3 degrees and 20 degrees, and each port may be angled differently.

As described above, in some implementations, the ported housing 120 may include a ramp 125. FIG. 3 shows the cross-sectional view of one example ramp 125 having an angle of inclination. In some implementations, as shown in the example of FIG. 3, the angle of inclination of the ramp 125 may be an angle of between 20 degrees and 60 degrees from a horizontal axis of the tool. It is noted however, that in other implementations the angle of inclination of the ramp 125 may be an angle in other angle ranges, such as an angle between 10 degrees and 70 degrees.

FIG. 3 may show the cross-sectional view of one of the flow trim sections of the flow trim 110 and one of the ported housing sections of the ported housing 120 that were shown in FIG. 1. For example, FIG. 3 may show a first flow trim section 111 and the first ported housing section 121, a second flow trim section 112 and a second ported housing section 122, a third flow trim section and a third ported housing section, or a fourth flow trim section and a fourth ported housing section.

Figure 4:
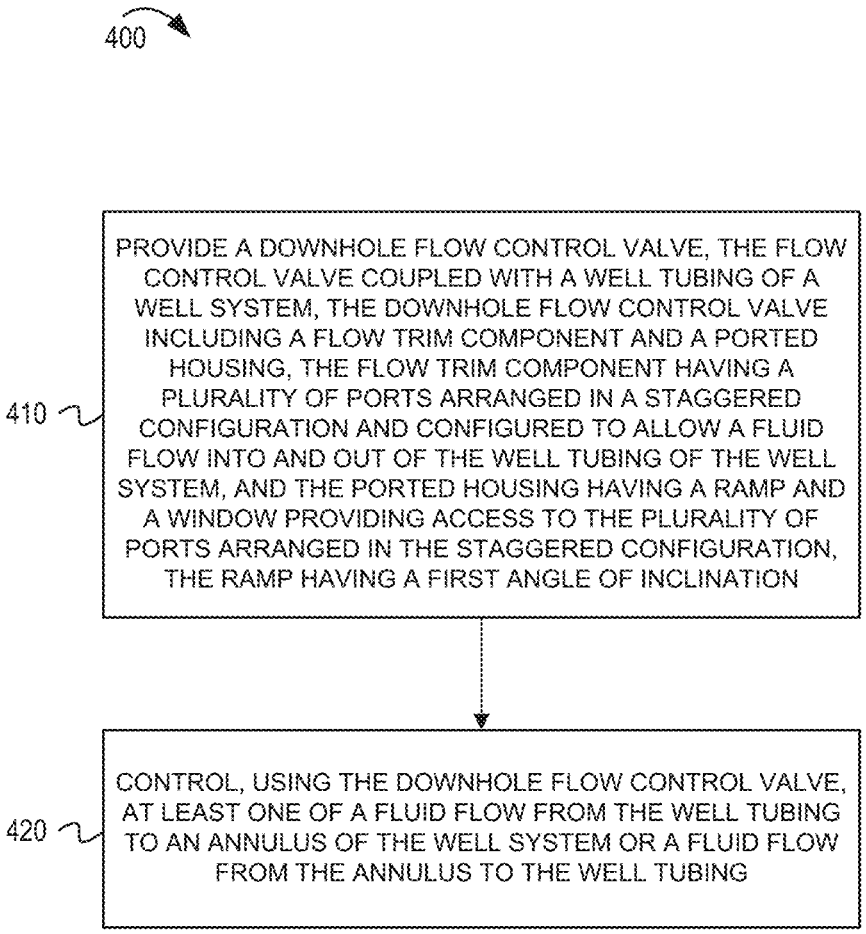
FIG. 4 is a flowchart of example operations for using a downhole flow control valve in a well system, according to some implementations.

FIG. 4 is a flowchart 400 of example operations for using a downhole flow control valve in a well system, according to some implementations. The operations may include providing the downhole flow control valve, the downhole flow control valve coupled with a well tubing of the well system. The downhole flow control valve may include a flow trim component and a ported housing. The flow trim component may have a plurality of ports arranged in a staggered configuration and configured to allow a fluid flow into and out of the well tubing of the well system. The ported housing may have a ramp and a window providing access to the plurality of ports arranged in the staggered configuration, the ramp having a first angle of inclination (block 410). The operations may include controlling, using the downhole flow control valve, at least one of a fluid flow from the well tubing to an annulus of the well system or a fluid flow from the annulus to the well tubing (block 420). In some implementations, each of the plurality of ports of the flow trim component may have a second angle of inclination. In some implementations, the downhole flow control valve may be an ICV.

Figure 5:
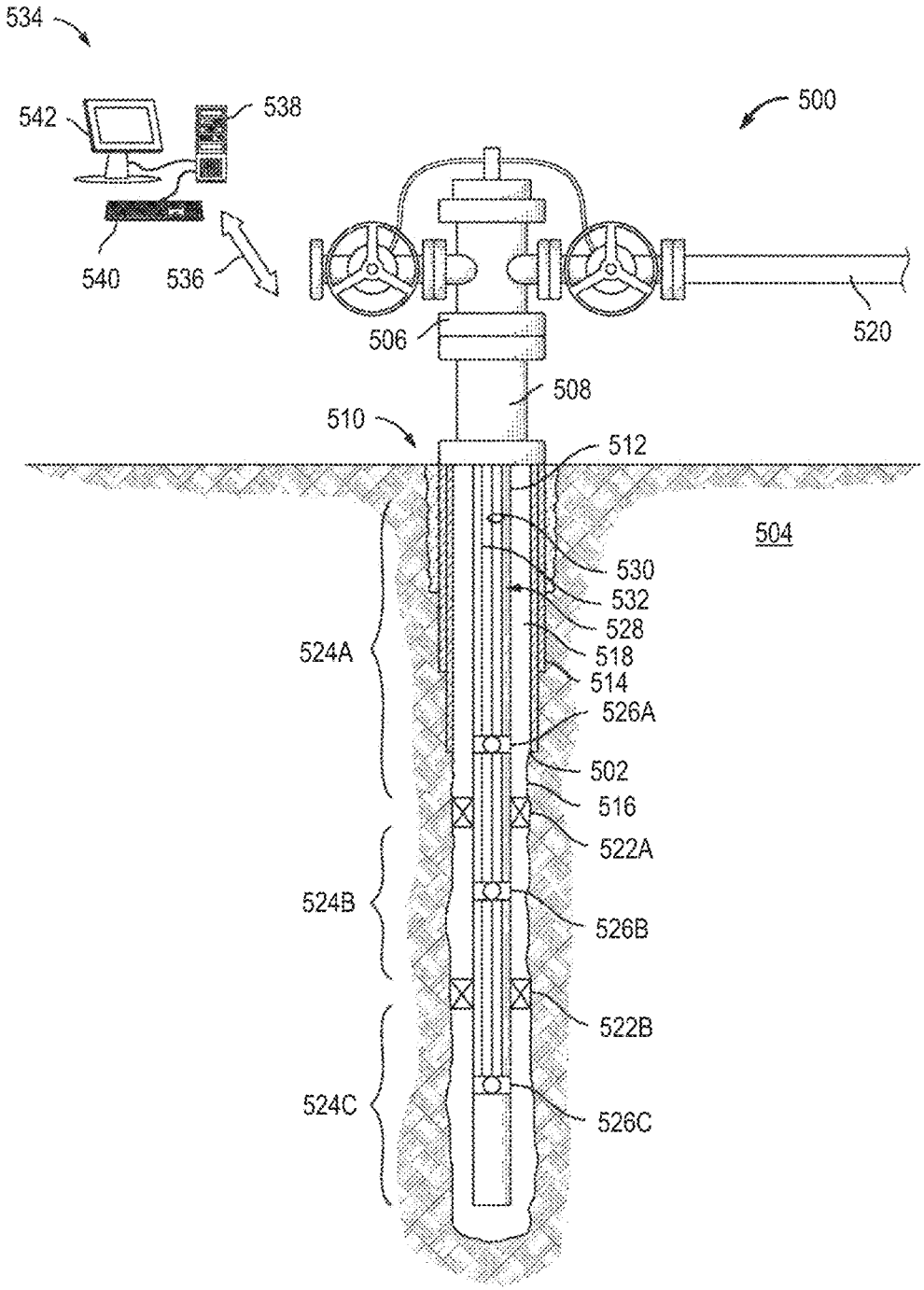
FIG. 5 is a schematic diagram of a drilling rig system as an example of oil services systems that use surface and downhole equipment, according to some implementations.

FIG. 5 is a schematic diagram of a well system 500, according to some implementations. Well system 500 may comprise a wellbore 502 formed within a formation 504. In some implementations, wellbore 502 may be a vertical wellbore as illustrated. Itis noted, however, that in other implementations the wellbore 502 may be a horizontal and/or a directional well. Furthermore, it is noted that while well system 500 may be illustrated as land-based, the present techniques may also be applicable in offshore applications. Formation 504 may be made up of several geological layers and include one or more hydrocarbon reservoirs. As illustrated, well system 500 may include a production tree 506 and a wellhead 508 located at a well site 510. Well tubing, such as a production tubing 512 may extend from wellhead 508 into wellbore 502, which may traverse formation 504.

In some implementations, wellbore 502 may be cased with one or more casing segments 514. Casing segments 514 help maintain the structure of wellbore 502 and prevent wellbore 502 from collapsing in on itself. The space between production tubing 512 and casing segments 514 or wellbore wall 516 may be an annulus 518. Production fluid may enter annulus 518 from formation 504 and then may enter production tubing 512 from annulus 518 through at least one of the downhole flow control valves 526A-526C. In some implementations, the downhole flow control valves 526A-526C may be the downhole flow control valve 100 described in FIGS. 1-4. Production tubing 512 may carry production fluid uphole to production tree 506. Production fluid may then be delivered to various surface facilities for processing via a surface pipeline 520.

In some implementations, wellbore 502 may be separated into a plurality of zones with packers 522A-B disposed in annulus 518. Packers 522 may separate wellbore 502 into zones 524A-524C. In some implementations, at least a portion of production tubing 512 and one of the downhole flow control valves 526A-526C may be disposed within each of the zones 524A-524C. During operations, when a downhole flow control valve (such as downhole flow control valve 526C) is open, fluid may flow from the respective zone (such as zone 524C) into production tubing 512. When the downhole flow control valve is closed, fluid from the respective zone is prevented from flowing into production tubing 512. Thus, the flow of formation fluid from each zone 524A-524C into production tubing 512 may be controlled through the actuation of the corresponding one of the downhole flow control valves 526A-526C (e.g., such as by the actuation of a sliding sleeve of the valve). In some implementations, the flow of fluid may be increased or decrease incrementally by "choking" a sliding sleeve of each of the downhole flow control valves 526A-526C.

In some implementations, the downhole flow control valves 526A-526C may be operated hydraulically and controlled by a valve control system 528. The valve control system 528 may include a hydraulic system with two hydraulic lines 530 and an electrical system with an electrical line 532. Additionally, in some implementations, the valve control system 528 may be connected to a computer system 534 through connection 536, which may be wired and/or wireless. The computer system 534 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, the computer system 534 may be a processing unit 538, a network storage device, or any other suitable device and may vary in size, shape, performance, functionality, and price. The computer system 534 may include random access memory (RAM), one or more processing resources such as a central processing unit (CPU) or hardware or software control logic, ROM, and/or other types of nonvolatile memory. Additional components of the computer system 534 may include one or more disk drives, one or more network ports for communication with external devices as well as an input device 540 (e.g., keyboard, mouse, etc.) and video display 542. The computer system 534 may also include one or more buses operable to transmit communications between the various hardware components.

Figure 6:
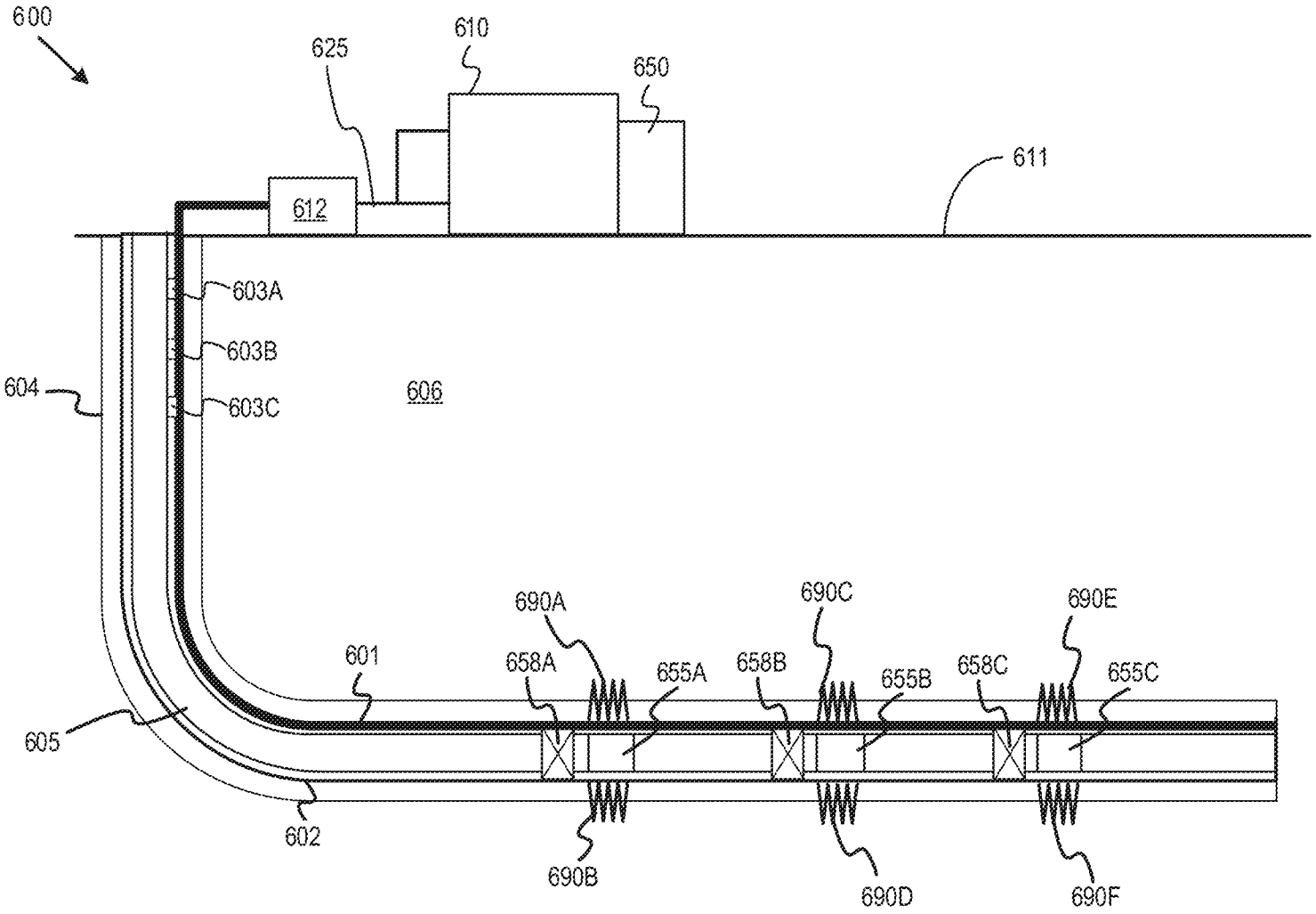
FIG. 6 is a schematic diagram of an example well system 600 that includes fracturing operations, according to some implementations.

FIG. 6 is a schematic diagram of an example well system 600 that includes fracturing operations, according to some implementations. A well system 600 may comprise a wellbore 604 in a subsurface formation 606. The wellbore 604 may include a casing 602 and a number of perforations 690A-690F being made in the casing 602 at different depths as part of hydraulic fracturing to allow hydraulic communication between the subsurface formation 606 and the casing 602 and to allow fracturing at different zones. The well system 600 may also include well tubing, such as an inner string 605 or completion string that may include one or more downhole well devices or tools. In some implementations, the inner string 605 (or completion string) may include one or more downhole flow control valves (such as the downhole flow control valve 100 described in FIGS. 1-4) and one or more packers. For example, as shown in FIG. 6, the inner string 605 may include downhole flow control valves 655A-655C and packers 658A-658C. It is noted, however, that the inner string 605 may include other well devices or tools that are not shown for simplicity.

In some implementations, the well system 600 also may include a fiber optic cable 601. The fiber optic cable 601 may be cemented in place in the annular space between the casing 602 of the wellbore 604 and the subsurface formation 606. In some implementations, the fiber optic cable 601 may be clamped to the outside of the casing 602 during deployment and protected by centralizers and cross coupling clamps. The fiber optic cable 601 may house one or more optical fibers, and the optical fibers may be single mode fibers, multi-mode fibers, or a combination of single mode and multi-mode optical fibers.

In some implementations, the fiber optic cable 601 may be used for distributed sensing where acoustic, strain, and temperature data may be collected. The data may be collected at various positions distributed along the fiber optic cable 601. For example, data may be collected every 1-3 ft along the full length of the fiber optic cable 601. The fiber optic cable 601 may be included with coiled tubing, wireline, loose fiber using coiled tubing, or gravity deployed fiber coils that unwind the fiber as the coils are moved in the wellbore 604. The fiber optic cable 601 also may be deployed with pumped down coils and/or self-propelled containers. Additional deployment options for the fiber optic cable 601 may include coil tubing and wireline deployed coils where the fiber optic cable 601 is anchored at the toe of the wellbore 604. In such embodiments, the fiber optic cable 601 may be deployed when the wireline or coiled tubing is removed from the wellbore 604. The distribution of sensors (such as sensors 603A-C) shown in FIG. 6 is for example purposes only. Any suitable sensor deployment may be used. For example, the well system 600 may include fiber optic cable deployed sensors or sensors cemented into the casing. Different types of sensors deployments also may be combined in a single well, such as including both sensors cemented to the casing and sensors in plugs, flow metering devices, etc. in a single well system.

In some implementations, a fiber optic interrogation unit 612 may be located on the surface 611 of the well system 600. The fiber optic interrogation unit 612 may be directly coupled to the fiber optic cable 601. Alternatively, the fiber optic interrogation unit 612 may be coupled to a fiber stretcher module, wherein the fiber stretcher module is coupled to the fiber optic cable 601. The fiber optic interrogation unit 612 may receive measurement values taken and/or transmitted along the length of the fiber optic cable 601 such as acoustic, temperature, strain, etc. The fiber optic interrogation unit 612 may be electrically connected to a digitizer to convert optically transmitted measurements into digitized measurements. The well system 600 may contain multiple sensors, such as sensors 603A-C. There may be any suitable number of sensors placed at any suitable location in the wellbore 604. The sensors 603A-C may include pressure sensors, distributed fiber optic sensors, point temperature sensors, point acoustic sensors, interferometric sensors or point strain sensors. Distributed fiber optic sensors may be capable of measuring distributed acoustic data, distributed temperature data, and distributed strain data. Any of the sensors 603A-C may be communicatively coupled (not shown) to other components of the well system 600 (e.g., the computer 610). In some implementations, the sensors 603A-C may be cemented to a casing 602.

In some implementations, a computer 610 may receive the electrically transmitted measurements from the fiber optic interrogation unit 612 using a connector 625. The computer 610 may include a signal processor to perform various signal processing operations on signals captured by the fiber optic interrogation unit 612 and/or other components of the well system 600. The computer 610 may have one or more processors and a memory device to analyze the measurements and graphically represent analysis results on the display device 650.

Although some example well systems are shown in FIGS. 5-6, it is noted, however, that the downhole flow control valves described in FIGS. 1-4 can be used in any type of well system in the oil and gas industry. For example, the well systems may be any type of drilling well systems, completion well systems, and producing well systems.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine-readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by or in connection with an instruction execution system, apparatus, or device. A machine-readable storage medium is not a machine-readable signal medium.

A machine-readable signal medium may include a propagated data signal with machine-readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

While the aspects of the disclosure are described with reference to various implementations and exploitations, it will be understood that these aspects are illustrative and that the scope of the claims is not limited to them. In general, techniques for implementing a downhole flow control valve as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations, and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

As used herein, the term "or" is inclusive unless otherwise explicitly noted. Thus, the phrase "at least one of A, B, or C"

is satisfied by any element from the set {A, B, C} or any combination thereof, including multiples of any element.

EXAMPLE EMBODIMENTS

Example Embodiments can include the following:

Embodiment #1: A downhole flow control valve for a well system, comprising: a flow trim component having a plurality of ports configured to allow a fluid flow into and out of a well tubing of the well system, the plurality of ports arranged in a staggered configuration; and a ported housing coupled with the flow trim component, the ported housing having a ramp and a window providing access to the plurality of ports in the staggered configuration, the ramp having a first angle of inclination.

Embodiment #2: The downhole flow control valve of Embodiment #1, wherein each of the plurality of ports of the flow trim component have a second angle of inclination.

Embodiment #3: The downhole flow control valve of Embodiment #1, wherein the flow trim component includes a first flow trim section and at least a second flow trim section positioned around a circumference of the flow trim component, the first flow trim section including a first plurality of staggered ports and the second flow trim section including a second plurality of staggered ports.

Embodiment #4: The downhole flow control valve of Embodiment #3, wherein the ported housing includes a first ported housing section and at least a second ported housing section positioned around a circumference of the ported housing, the first ported housing section including a first ramp and a first window and the second ported housing section including a second ramp and a second window.

Embodiment #5: The downhole flow control valve of Embodiment #4, wherein: the flow trim component includes three or more flow trim sections including the first flow trim section, the second flow trim section, and at least a third flow trim section positioned around the circumference of the flow trim component, the third flow trim section including a third plurality of staggered ports; and the ported housing including three or more ported housing sections including the first ported housing section, the second ported housing section, and at least a third ported housing section positioned around the circumference of the ported housing, the third ported housing section including a third ramp and a third window.

Embodiment #6: The downhole flow control valve of Embodiment #4, wherein the ported housing includes a plurality of ported housing sections including at least the first ported housing section having the first ramp and the second ported housing section having the second ramp, and wherein: at least the first ramp and the second ramp have the first angle of inclination, and the first angle of inclination is between twenty degrees and sixty degrees, or at least the first ramp has the first angle of inclination between twenty degrees and sixty degrees and at least the second ramp has a different angle of inclination between twenty degrees and sixty degrees.

Embodiment #7: The downhole flow control valve of Embodiment #4, wherein the flow trim component includes a plurality of flow trim sections including at least the first flow trim section including the first plurality of staggered ports and the second flow trim section including the second plurality of staggered ports, and wherein: at least the first plurality of staggered ports and the second plurality of staggered ports have a second angle of inclination, and the second angle of inclination is between five degrees and fifteen degrees, or one or more ports of the first plurality of staggered ports and the second plurality of staggered ports have the second angle of inclination between five degrees and fifteen degrees and one or more different ports of the first plurality of staggered ports and the second plurality of staggered ports have a different angle of inclination between five degrees and fifteen degrees.

Embodiment #8: The downhole flow control valve of Embodiment #1, wherein the flow trim component having the plurality of ports arranged in the staggered configuration is configured to control and widely distribute the fluid flow into and out of the well tubing of the well system, and the ramp is configured to smooth a fluid flow and a change in a flow direction of the fluid flow.

Embodiment #9: The downhole flow control valve of Embodiment #1, wherein the downhole flow control valve is an interval control valve (ICV).

Embodiment #10: A well system, comprising: a well tubing; and a downhole flow control valve coupled with the well tubing, the downhole flow control valve including: a flow trim component having a plurality of ports configured to allow a fluid flow into and out of the well tubing of the well system, the plurality of ports arranged in a staggered configuration; and a ported housing coupled with the flow trim component, the ported housing having a ramp and a window providing access to the plurality of ports in the staggered configuration, the ramp having a first angle of inclination.

Embodiment #11: The well system of Embodiment #10, wherein each of the plurality of ports of the flow trim component have a second angle of inclination.

Embodiment #12: The well system of Embodiment #10, wherein the flow trim component includes a first flow trim section and at least a second flow trim section positioned around a circumference of the flow trim component, the first flow trim section including a first plurality of staggered ports and the second flow trim section including a second plurality of staggered ports.

Embodiment #13: The well system of Embodiment #12, wherein the ported housing includes a first ported housing section and at least a second ported housing section positioned around a circumference of the ported housing, the first ported housing section including a first ramp and a first window and the second ported housing section including a second ramp and a second window.

Embodiment #14: The well system of Embodiment #13, wherein: the flow trim component includes three or more flow trim sections including the first flow trim section, the second flow trim section, and at least a third flow trim section positioned around the circumference of the flow trim component, the third flow trim section including a third plurality of staggered ports; and the ported housing including three or more ported housing sections including the first ported housing section, the second ported housing section, and at least a third ported housing section positioned around the circumference of the ported housing, the third ported housing section including a third ramp and a third window.

Embodiment #15: The well system of claim 13, wherein the ported housing includes a plurality of ported housing sections including at least the first ported housing section having the first ramp and the second ported housing section having the second ramp, and the flow trim component includes a plurality of flow trim sections including at least the first flow trim section including the first plurality of staggered ports and the second flow trim section including the second plurality of staggered ports, and wherein: at least the first ramp and the second ramp have the first angle of inclination, and the first angle of inclination is between twenty degrees and sixty degrees, or at least the first ramp has the first angle of inclination between twenty degrees and sixty degrees and at least the second ramp has a different angle of inclination between twenty degrees and sixty degrees; and at least the first plurality of staggered ports and the second plurality of staggered ports have a second angle of inclination, and the second angle of inclination is between five degrees and fifteen degrees, or one or more ports of the first plurality of staggered ports and the second plurality of staggered ports have the second angle of inclination between five degrees and fifteen degrees and one or more different ports of the first plurality of staggered ports and the second plurality of staggered ports have a different angle of inclination between five degrees and fifteen degrees.

Embodiment #16: A method for using a downhole flow control valve in a well system, the method comprising: providing the downhole flow control valve, the downhole flow control valve coupled with a well tubing of the well system, the downhole flow control valve including a flow trim component and a ported housing, the flow trim component having a plurality of ports arranged in a staggered configuration and configured to allow a fluid flow into and out of the well tubing of the well system, and the ported housing having a ramp and a window providing access to the plurality of ports arranged in the staggered configuration, the ramp having a first angle of inclination; and controlling, using the downhole flow control valve, at least one of a fluid flow from the well tubing to an annulus of the well system or a fluid flow from the annulus to the well tubing.

Embodiment #17: The method of Embodiment #16, wherein each of the plurality of ports of the flow trim component have a second angle of inclination.

Embodiment #18: The method of Embodiment #16, wherein the flow trim component includes a first flow trim section and at least a second flow trim section positioned around a circumference of the flow trim component, the first flow trim section including a first plurality of staggered ports and the second flow trim section including a second plurality of staggered ports.

Embodiment #19: The method of Embodiment #18, wherein the ported housing includes a first ported housing section and at least a second ported housing section positioned around a circumference of the ported housing, the first ported housing section including a first ramp and a first window and the second ported housing section including a second ramp and a second window.

Embodiment #20: The method of Embodiment #19, wherein: the flow trim component includes the first flow trim section, the second flow trim section, a third flow trim section, and a fourth flow trim section positioned around the circumference of the flow trim component, the third flow trim section including a third plurality of staggered ports and the fourth flow trim section including a fourth plurality of staggered ports; and the ported housing including the first ported housing section, the second ported housing section, a third ported housing section, and a fourth ported housing section positioned around the circumference of the ported housing, the third ported housing section including a third ramp and a third window and the fourth ported housing section including a fourth ramp and a fourth window.

What is claimed is:

1. A downhole flow control valve for a well system, comprising:

a flow trim component having a plurality of ports configured to allow a fluid flow into and out of a well tubing of the well system, the plurality of ports arranged in a staggered configuration; and a ported housing coupled with the flow trim component, the ported housing having a ramp and a window providing access to the plurality of ports in the staggered configuration, the ramp having a first angle of inclination, and each of the plurality of ports of the flow trim component having a different angle of inclination than the first angle of inclination.

2. The downhole flow control valve of claim 1, wherein the flow trim component includes a first flow trim section and at least a second flow trim section, the first flow trim section positioned at a different radial angle around a circumference of the flow trim component as the second flow trim section, the first flow trim section including a first plurality of staggered ports and the second flow trim section including a second plurality of staggered ports.

3. The downhole flow control valve of claim 2, wherein the ported housing includes a first ported housing section and at least a second ported housing section, the first ported housing section positioned at a different radial angle around a circumference of the ported housing as the second ported housing section, the first ported housing section including a first ramp and a first window providing access to the first plurality of staggered ports and the second ported housing section including a second ramp and a second window providing access to the second plurality of staggered ports.

4. The downhole flow control valve of claim 3, wherein:

the flow trim component includes three or more flow trim sections including the first flow trim section, the second flow trim section, and at least a third flow trim section positioned around the circumference of the flow trim component, the third flow trim section including a third plurality of staggered ports; and the ported housing including three or more ported housing sections including the first ported housing section, the second ported housing section, and at least a third ported housing section positioned around the circumference of the ported housing, the third ported housing section including a third ramp and a third window.

5. The downhole flow control valve of claim 3, wherein the ported housing includes a plurality of ported housing sections including at least the first ported housing section having the first ramp and the second ported housing section having the second ramp, and wherein:

at least the first ramp and the second ramp have the first angle of inclination, and the first angle of inclination is between twenty degrees and sixty degrees, or at least the first ramp has the first angle of inclination between twenty degrees and sixty degrees and at least the second ramp has a second angle of inclination between twenty degrees and sixty degrees, the second angle of inclination being different than the first angle of inclination.

6. The downhole flow control valve of claim 3, wherein the flow trim component includes a plurality of flow trim sections including at least the first flow trim section including the first plurality of staggered ports and the second flow trim section including the second plurality of staggered ports, and wherein:

at least the first plurality of staggered ports and the second plurality of staggered ports have a second angle of inclination, and the second angle of inclination is between five degrees and fifteen degrees, or one or more ports of the first plurality of staggered ports and the second plurality of staggered ports have the second angle of inclination between five degrees and fifteen degrees and one or more different ports of the first plurality of staggered ports and the second plurality of staggered ports have a third angle of inclination between five degrees and fifteen degrees, the third angle of inclination being different than the second angle of inclination.

7. The downhole flow control valve of claim 1, wherein the flow trim component having the plurality of ports arranged in the staggered configuration is configured to control and widely distribute the fluid flow into and out of the well tubing of the well system, and the ramp is configured to smooth a fluid flow and a change in a flow direction of the fluid flow.

8. The downhole flow control valve of claim 1, wherein the downhole flow control valve is an interval control valve (ICV).

9. A well system, comprising:

a well tubing; and a downhole flow control valve coupled with the well tubing, the downhole flow control valve including:

a flow trim component having a plurality of ports configured to allow a fluid flow into and out of the well tubing of the well system, the plurality of ports arranged in a staggered configuration; and a ported housing coupled with the flow trim component, the ported housing having a ramp and a window providing access to the plurality of ports in the staggered configuration, the ramp having a first angle of inclination, and each of the plurality of ports of the flow trim component having a different angle of inclination than the first angle of inclination.

10. The well system of claim 9, wherein the flow trim component includes a first flow trim section and at least a second flow trim section, the first flow trim section positioned at a different radial angle around a circumference of the flow trim component as the second flow trim section, the first flow trim section including a first plurality of staggered ports and the second flow trim section including a second plurality of staggered ports.

11. The well system of claim 10, wherein the ported housing includes a first ported housing section and at least a second ported housing section, the first ported housing section positioned at a different radial angle around a circumference of the ported housing as the second ported housing section, the first ported housing section including a first ramp and a first window providing access to the first plurality of staggered ports and the second ported housing section including a second ramp and a second window providing access to the second plurality of staggered ports.

12. The well system of claim 11, wherein:

the flow trim component includes three or more flow trim sections including the first flow trim section, the second flow trim section, and at least a third flow trim section positioned around the circumference of the flow trim component, the third flow trim section including a third plurality of staggered ports; and the ported housing including three or more ported housing sections including the first ported housing section, the second ported housing section, and at least a third ported housing section positioned around the circumference of the ported housing, the third ported housing section including a third ramp and a third window.

13. The well system of claim 11, wherein the ported housing includes a plurality of ported housing sections including at least the first ported housing section having the first ramp and the second ported housing section having the second ramp, and the flow trim component includes a plurality of flow trim sections including at least the first flow trim section including the first plurality of staggered ports and the second flow trim section including the second plurality of staggered ports, and wherein:

at least the first ramp and the second ramp have the first angle of inclination, and the first angle of inclination is between twenty degrees and sixty degrees, or at least the first ramp has the first angle of inclination between twenty degrees and sixty degrees and at least the second ramp has a second angle of inclination between twenty degrees and sixty degrees, the second angle of inclination being different than the first angle of inclination; and at least the first plurality of staggered ports and the second plurality of staggered ports have a third angle of inclination, and the third angle of inclination is between five degrees and fifteen degrees, or one or more ports of the first plurality of staggered ports and the second plurality of staggered ports have the third angle of inclination between five degrees and fifteen degrees and one or more different ports of the first plurality of staggered ports and the second plurality of staggered ports have a fourth angle of inclination between five degrees and fifteen degrees, the fourth angle of inclination being different than the third angle of inclination.

14. A method for using a downhole flow control valve in a well system, the method comprising:

providing the downhole flow control valve, the downhole flow control valve coupled with a well tubing of the well system, the downhole flow control valve including a flow trim component and a ported housing, the flow trim component having a plurality of ports arranged in a staggered configuration and configured to allow a fluid flow into and out of the well tubing of the well system, and the ported housing having a ramp and a window providing access to the plurality of ports arranged in the staggered configuration, the ramp having a first angle of first angle of inclination, and each of the plurality of ports of the flow trim component having a different angle of inclination than the first angle of inclination; and controlling, using the downhole flow control valve, at least one of a fluid flow from the well tubing to an annulus of the well system or a fluid flow from the annulus to the well tubing.

15. The method of claim 14, wherein the flow trim component includes a first flow trim section and at least a second flow trim section, the first flow trim section positioned at a different radial angle around a circumference of the flow trim component as the second flow trim section, the first flow trim section including a first plurality of staggered ports and the second flow trim section including a second plurality of staggered ports.

16. The method of claim 15, wherein the ported housing includes a first ported housing section and at least a second ported housing section, the first ported housing section positioned at a different radial angle around a circumference of the ported housing as the second ported housing section, the first ported housing section including a first ramp and a first window providing access to the first plurality of staggered ports and the second ported housing section including a second ramp and a second window providing access to the second plurality of staggered ports.

17. The method of claim 16, wherein:

the flow trim component includes the first flow trim section, the second flow trim section, a third flow trim section, and a fourth flow trim section positioned around the circumference of the flow trim component, the third flow trim section including a third plurality of staggered ports and the fourth flow trim section including a fourth plurality of staggered ports; and the ported housing including the first ported housing section, the second ported housing section, a third ported housing section, and a fourth ported housing section positioned around the circumference of the ported housing, the third ported housing section including a third ramp and a third window and the fourth ported housing section including a fourth ramp and a fourth window.

* * * * *